US005746908A

United States Patent [19]

Mitchell

[11] Patent Number: 5,746,908

[45] Date of Patent: May 5, 1998

[54] CRUDE OIL DESALTING PROCESS

[75] Inventor: Kent E. Mitchell, Bartlesville, Okla.

[73] Assignee: Phillips Petroleum Company, Bartlesville, Okla.

[21] Appl. No.: 599,913

[22] Filed: Feb. 12, 1996

[51] Int. Cl.[6] ..... C10G 17/00

[52] U.S. Cl. ..... 208/251 R; 208/47; 208/188

[58] Field of Search ..... 208/251 H, 188, 208/251 R, 47

[56] References Cited

U.S. PATENT DOCUMENTS

| | | | |
|---|---|---|---|
| 3,582,489 | 6/1971 | Meadow et al. | 204/190 |
| 3,623,608 | 11/1971 | Waterman | 210/210 |
| 3,888,760 | 6/1975 | Ebert | 208/48 |
| 4,339,330 | 7/1982 | Fujiwara et al. | 208/51 R |
| 4,414,104 | 11/1983 | Delany et al. . | |
| 4,415,434 | 11/1983 | Hargreaves et al. | 208/11 R |
| 4,859,310 | 8/1989 | Fitzharris et al. | 208/87 |
| 4,992,210 | 2/1991 | Naeger et al. | 252/389 |
| 5,114,566 | 5/1992 | Naeger et al. | 208/289 |
| 5,219,471 | 6/1993 | Goyal et al. | 208/188 |

*Primary Examiner*—Helane Myers
*Attorney, Agent, or Firm*—Lucas K. Shay

[57] ABSTRACT

A process for desalting a crude oil comprises (1) injecting steam into the oil to form a steam-injected oil; (2) adding water to the steam-injected oil to form a mixture; (3) introducing the mixture to a desalter; (4) inducing the formation of aqueous phase and oil phase; and (5) separating the oil phase from the aqueous phase. Where there are two desalting stages for desalting crude oil, the process can be carried out in either the first stage or second stage, or both stages. The process can also be similarly employed in a multistage desalting process.

23 Claims, No Drawings

CRUDE OIL DESALTING PROCESS

FIELD OF THE INVENTION

The present invention relates to a process for reducing salt content in a crude oil.

BACKGROUND OF THE INVENTION

In a crude oil refining process for producing gasoline and other hydrocarbon-containing products, a crude oil feedstock is cracked in a reactor in the presence of a catalyst. Generally a crude oil contains many impurities that are detrimental to not only the refinery operation but also the refined products. Salts, mainly metal salts including metal halides such as magnesium chloride, sodium chloride, and calcium chloride, and other metals salts, are among these impurities. It is well known that salts contribute to corrosion of refinery equipment such as the fractionators, to decreased heat transfer efficiency due to fouling of heat exchangers and coking of furnaces, and to catalyst poisoning.

For years, crude oil desalting is carried out by adding water to a crude oil to form an oil-water mixture. The oil-water mixture is then heated at about 120° C. and under a sufficient pressure to prevent evaporation of water or crude oil. A portion of the salts are now dissolved in water. Upon heating, water and oil phases are formed and separated by using emulsion-breaking chemicals or demulsifiers, or developing a high-potential electric field to coalesce or polarize the water droplets, or both. The water phase is then removed and the oil phase is pumped further downstream through a series of heat exchangers for refinery operation.

Generally about 90% or more of the salt content can be reduced in a one-stage desalting process as described above. A two-stage desalting process can remove a few more percent of salt content in crude oil. However, it is discovered in many refinery operations that crude oils recovered in a two-stage desalting process still cause corrosion to refinery equipment. Such corrosion is believed to be caused by hard-to-extract salts originally present in crude oils. Corrosion to refinery equipment adds manufacturing costs to final products. The added costs are either absorbed by the manufacturers or paid by consumers. There is therefore an ever-increasing need to develop a process to further remove the hard-to-extract salts. Because the large volume of refined products, a seemingly small improvement can translate into a huge savings to consumers.

SUMMARY OF THE INVENTION

An object of the present invention is to provide a process for treating a crude oil. Another object of the present invention is to provide a process for reducing salt content in a crude oil. An advantage of the present invention is that the salt content can be substantially reduced with very little added cost to a desalting process. Other objects and advantages will become more apparent as the invention is more fully disclosed hereinbelow.

According to the present invention, a process which can be used for reducing salt content in crude oils is provided. The process comprises, consists essentially of, or consists of, the steps of: (1) combining a steam with a fluid to form a first mixture in which the fluid comprises a hydrocarbon, such as a crude oil, and a salt; (2) introducing water into the first mixture to form a second mixture; and (3) separating the hydrocarbon in the second mixture from water to effect the reduction of the salt content in the fluid. The process can also comprise, consist essentially of, or consist of, the steps of:

(1) combining water with a fluid to form a first mixture in which the fluid comprises a hydrocarbon, such as a crude oil, and a salt; (2) introducing a steam into the first mixture to form a second mixture; and (3) separating the hydrocarbon from the water to effect the reduction of the salt content in the fluid.

DETAILED DESCRIPTION OF THE INVENTION

The first step of the process of the present invention is directed to combining a steam with a hydrocarbon and salt-containing fluid. The combining can be achieved by any means known to one skilled in the art. Examples of suitable means include, but are not limited to, injection, mixing tees, and combinations thereof. The presently preferred means is an injection of steam into the fluid while the fluid is being transported to a desalting facility.

The physical form of the fluid can be a liquid or combination of liquid and gas. The presently preferred physical form of fluid is liquid. Examples of suitable fluid include, but are not limited to, crude oils, gas oils, crude oils that have been previously desalted, and combinations of any two or more thereof. The term "hydrocarbon" is also used for these oils.

The steam can be generated by any known methods. Generally, the steam employed in the present invention can be generated from regular tap water, distilled water, deionized water, water containing desalting chemicals, water containing normal steam treatment chemicals known to one skilled in the art, and combinations of any two or more thereof. The presently employed steam is generated from tap water because it is inexpensive and readily available.

The timing of combining steam with the fluid is not important as long as the combination is about 1 second to about 1 hour, preferably about 1 second to about 10 minutes, more preferably about 1 second to about 5 minute, and most preferably 5 seconds to 1 minute before the introduction of water to the mixture containing steam.

According to the present invention, the steam can be any temperature so long as the temperature can effect or facilitate the reduction of salt content in the fluid. Additionally, the steam temperature is generally dependent on steam pressure which is generally high so that steam can be introduced to the fluid. Generally the steam pressure can be in the range of from about 15 psig to about 1,000 psig, preferably about 40 psig to about 600 psig, and most preferably 80 psig to 400 psig. The temperature can then be in the range of from about 105° C. to about 280° C., preferably about 130° C. to about 250° C., and most preferably 160° C. to 230° C.

The salts in the fluid generally are associated with the fluid during recovery thereof. For example, crude oils recovered from a subterranean formation generally are contaminated with those salts present in the formation brines or oil field brines. Examples of salts include magnesium chloride, calcium chloride, sodium chloride, calcium bromide, zinc bromide, magnesium sulfate, sodium sulfate, or combinations of any two or more thereof. Generally, the salt content in crude oils varies from crude oils to crude oils and can be in the range of from about 20 to about 2,000 mg per Kg of crude oil.

The quantity of steam required can be any quantity that can effect the reduction in salt content in the fluid. Generally, the quantity can be in the range of from about 1 to about 200, preferably about 2 to about 150, and most preferably 5 to 100 grams of steam per Kg of fluid or crude oil.

After the first mixture is formed as described above, water is introduced into the first mixture. Water as used herein can be any water such as, for example, tap water, alkaline water, acidic water, distilled water, spring water, water recycled to the desalting process, or combinations of any two or more thereof. Presently it is preferred that the readily available tap water, or water recycled to the desalting process, be used for its convenience and low cost. The term "introduction" or "introducing" or means thereof is interchangeable with "combination" or "combining", respectively, which has been discussed above.

According to the present invention, water of any temperature can be used. Presently it is preferred that water as received be used. The water temperature can be in the range of from about 1 to about 99° C. The quantity of water can be any quantity that can effect the reduction in salt content of the fluid. Generally, water addition to the steam-containing first mixture facilitates the formation of an oil-water emulsion thereby transferring the salts from oil to water. As such, the quantity of water required can be any quantity that can facilitate the formation of such an emulsion and can be in the range of from about 1 to about 25, preferably 2 to about 20, and most preferably 4 to 15% of the fluid by weight.

Once the water introduction is completed, a second mixture or an oil-water mixture is formed. The second mixture is now transported to a desalter or desalting unit. Because a desalter is well known to one skilled in the art, the description of such a desalter is omitted herein for the interest of brevity.

In the third step of the present invention, the second mixture now in the desalter can be heated, if desired, under any condition so long as the condition can effect the reduction in salt content in the fluid. The first mixture or the second mixture before entering the desalter can also be heated under any condition so long as the condition can effect the reduction in salt content in the fluid. Generally, such a condition can include a temperature in the range of from about 50° to about 250°, preferably about 600° to about 200°, more preferably about 75° to 180°, and most preferably 80° to 150° C. or about 120° C. Such a condition also includes a suitable pressure that is effective to prevent water or hydrocarbon-containing fluid, or both, from evaporating. Examples of suitable pressure can be in the range of from about 1 to about 40, preferably about 1 to about 30, and most preferably 1 to 20 atmospheres (atm). The time required for heating can be any time period so long as the time period can effect reduction in the salt content in the fluid.

The above disclosed process can be carried out in any vessels or conduits, or combinations thereof. It can also be carried out either batchwise or continuously, or both. For example, a crude oil-containing fluid can be conveyed from a crude oil source continuously by and through a pipe, during which a steam and then water are introduced to the fluid stream, to a desalter.

Generally, an emulsion-breaking agent or demulsifier can then be added in sufficient quantity to the oil-water mixture in the desalter to induce the formation of an aqueous phase, which contains most of the salts present in the hydrocarbon-containing fluid, and a nonaqueous phase which contains a salt-reduced fluid. Any commercially available emulsion-breaking agent can be used. The formation of an aqueous phase and a nonaqueous phase can also be induced by developing a high-potential electric field to coalesce or polarize the water droplets. Because these methods are well known to one skilled in the art, description of which is omitted herein for the interest of brevity.

The salt-reduced fluid can then be separated from the aqueous phase by any means known to one skilled in the art such as, for example, using electrostatic coalescers, by draining the heavier aqueous phase in the bottom, by removing the nonaqueous phase from the top, and combinations of any two or more thereof.

The salt-reduced fluid now can be directed further downstream for refinement. For example, if the fluid is a crude oil, such salt-reduced crude oil can be subject to distillation if needed, followed by catalytic cracking to produce gasoline and/or other hydrocarbon products.

The salt-reduced fluid, if needed, can also be re-treated by and through the process steps disclosed above to further reduce its salt content in a so-called two-stage desalting process.

In a two-stage desalting process, a process can also be carried out as follows. In the first stage desalting process, the process steps two and three disclosed above can be used to produce a first salt-reduced fluid such as, for example, crude oil. The first salt-reduced fluid now can be processed according to the steps disclosed above.

It should also be noted, as disclosed above in the Summary of the Invention, that the combination of steam with the fluid can also be carried out after water is introduced to the fluid. This alternative process can employ the same conditions disclosed above. Those conditions are incorporated herein for the interest of brevity.

The following non-limiting examples are provided to illustrate the process of the invention.

EXAMPLE I

This example illustrates a conventional desalting process.

In a conventional two stage desalter, crude oil feed, at a continuous rate of 11.2 gallons per hour, was mixed with the water effluent from the second stage desalter. The water content of the mixture was about 7 volume percent. The mixture was heated to 200° F. and mixed with a demulsifying chemical (Embreak 2W157, obtained from Betz Process Chemicals, The Woodlands, Tex.) to give a chemical concentration of 3 ppm (mg/Kg). The mixture was then passed through a static mixer and transferred to the first stage of the desalter where the oil and water were separated. The water was taken off the bottom for disposal while the oil was taken off the top. The oil was mixed with the water feed to form another mixture. The another mixture was heated to 200° F. and mixed with the demulsifying chemical to give a chemical concentration of 3 ppm. The mixture was passed through a static mixer and transferred to the second stage of the desalter where the oil and water were separated. The water was taken off the bottom and transferred to the first stage while the desalted oil was taken off the top. The salt content of the desalted oil was measured using a GCA/Precision Scientific Salt-In-Crude Analyzer which is well known to one skilled in the art.

To ensure that the crude oil was completely desalted, the desalted oil leaving the second stage was recycled back to the feed tank and fed to the first stage again. This was continued until the salt level in the desalted crude crude showed no change. For the crude oil tested, this was at a salt level of 1.3 pounds per 1000 barrels crude (ptb).

EXAMPLE II

This example illustrates an invention process.

The invention desalting process was run in an identical fashion to the conventional desalting described in EXAMPLE I except that steam was charged to the crude oil out of the first stage prior to water addition. The steam was plant steam regulated down to a pressure about 5 psi above that of the desalter, which is 100 psig. As a result of the steam addition, the second stage temperature was 250° F. The oil used was the oil that had previously been desalted in EXAMPLE I. With the invention process, the salt level in the desalted crude oil dropped to 0.3 ptb.

Comparing the results shown in EXAMPLE I and II, it is clear that steam addition to oil resulted in more than 76% reduction in salt content in the oil. The results also demonstrate the effect of steam on oil desalting process.

The results shown in the above examples clearly demonstrate that the present invention is well adapted to carry out the objects and attain the ends and advantages mentioned as well as those inherent therein. While modifications may be made by those skilled in the art, such modifications are encompassed within the spirit of the present invention as defined by the disclosure and the claims.

That which is claimed:

1. A process comprising: (1) combining steam with a fluid to form a first mixture wherein said fluid comprises a hydrocarbon and a salt; (2) introducing water into said first mixture to form a second mixture; and (3) separating said hydrocarbon in said second mixture from water under a condition effective to reduce the salt content in said fluid and to form a salt-reduced fluid containing said hydrocarbon wherein the weight % of water in said second mixture is in the range of from about 1 to about 25%.

2. A process according to claim 1 wherein said second mixture is heated under a condition effective to reduce the salt content in said fluid.

3. A process according to claim 1 wherein said hydrocarbon comprises oil.

4. A process according to claim 1 wherein the time elapsed between step (1) and step (2) is in the range of from about 1 second to about 1 hour.

5. A process according to claim 1 wherein the time elapsed between step (1) and step (2) is in the range of from 5 seconds to 1 minute.

6. A process according to claim 1 wherein said steam is present in the range of from about 1 gram to about 200 grams per Kg of said fluid.

7. A process according to claim 1 wherein said steam is present in the range of from 5 to 100 grams per Kg of said fluid.

8. A process according to claim 1 further comprising: (1) combining said salt-reduced fluid with a steam to form a third mixture; (2) introducing water to said third mixture to form a fourth mixture; and (3) separating said hydrocarbon in said fourth mixture under a condition effective to form a second salt-reduced fluid containing said hydrocarbon.

9. A process according to claim 8 wherein steps (2) to (3) are repeated.

10. A process according to claim 8 wherein said hydrocarbon comprises oil.

11. A process according to claim 8 wherein the time elapsed between step (1) and step (2) is in the range of from 5 seconds to 1 minute.

12. A process according to claim 8 wherein said steam is present in the range of from 5 to 100 grams per Kg of said salt-reduced fluid.

13. A process for reducing salt concentration in a crude oil comprising the steps of: (1) introducing water to said crude oil to form an oil-water mixture; (2) heating said oil-water mixture under a sufficient condition to effect the formation of an aqueous phase and a salt-reduced crude oil; (3) separating said salt-reduced crude oil from said aqueous phase; (4) introducing steam to said salt-reduced crude oil to from a steam-oil mixture; (5) introducing water to said steam-oil mixture to form a steam-oil-water mixture; (6) treating said steam-oil-water mixture under a sufficient condition to effect the formation of a second aqueous phase and a second salt-reduced crude oil; and (7) separating said second salt-reduced crude oil from said second aqueous phase.

14. A process according to claim 13 wherein said treating in step 6 is heating.

15. A process according to claim 13 wherein the time elapsed between step (4) and step (5) is in the range of from about 1 second to about 1 hour.

16. A process according to claim 13 wherein the time elapsed between step (4) and step (5) is in the range of from 5 seconds to 1 minute.

17. A process according to claim 13 wherein said steam is present in the range of from about 1 g to about 200 g per Kg of said salt-reduced crude oil.

18. A process according to claim 13 wherein said steam is present in the range of from 5 g to 100 g per Kg of said salt-reduced crude oil.

19. A process comprising: (1) combining water with a fluid to from a first mixture wherein said fluid comprises a hydrocarbon and a salt; (2) introducing a steam into said first mixture to form a second mixture; and (3) separating said hydrocarbon in said second mixture from water under a condition effective to reduce the salt content in said fluid.

20. A process according to claim 19 wherein said second mixture is heated under a condition effective to reduce the salt content in said fluid.

21. A process according to claim 19 wherein said steam is present in the range of from 5 to 100 grams per Kg of said fluid.

22. A process for reducing salt concentration in a crude oil comprising the steps of: (1) introducing water to said crude oil to form an oil-water mixture wherein the quantity of water is in the range of from 4 to 15 weight % of crude oil; (2) heating said oil-water mixture at a temperature in the range of from 80° to 150° C. and under a pressure in the range of from 1 to 20 atm; (3) inducing the formation of an aqueous phase and a nonaqueous phase containing salt-reduced crude oil; (4) separating said nonaqueous phase from said aqueous phase; (5) introducing steam to said nonaqueous phase to form a steam-oil mixture wherein said steam is present in the range of from 1 to 100 g per gram of said salt-reduced crude oil; (6) introducing water to said steam-oil mixture to form a steam-oil-water mixture; (7) heating said a steam-oil-water mixture at a temperature in the range of from 80° to 150° C. and under a pressure in the range of from 1 to 20 atm; (8) inducing the formation of a second aqueous phase and a second nonaqueous phase contianing second salt-reduced crude oil; and (9) separating said second nonaqueous phase from said second aqueous phase.

23. A process according to claim 1 wherein said first mixture or second mixture or both is in a hydrocarbon desalter.

* * * * *